US008225881B2

(12) United States Patent
Silva, Jr.

(10) Patent No.: US 8,225,881 B2
(45) Date of Patent: Jul. 24, 2012

(54) DRY SPRINKLER WITH DIVERTER SEAL ASSEMBLY

(75) Inventor: Manuel R. Silva, Jr., Cranston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 12/436,290

(22) Filed: May 6, 2009

(65) Prior Publication Data

US 2009/0211772 A1 Aug. 27, 2009

Related U.S. Application Data

(63) Continuation of application No. 11/000,129, filed on Dec. 1, 2004, now Pat. No. 7,559,376.

(51) Int. Cl.
*A62C 37/08* (2006.01)
*A62C 35/00* (2006.01)

(52) U.S. Cl. ..... 169/37; 169/17; 169/41

(58) Field of Classification Search ..... 169/16, 169/17, 37, 38, 41, 42, 56–58; 239/498, 239/518, 524
See application file for complete search history.

(56) References Cited

U.S. PATENT DOCUMENTS

| | | | |
|---|---|---|---|
| 1,338,469 | A | 4/1920 | Waage et al. |
| 1,903,150 | A | 3/1933 | Tyden |
| 2,155,990 | A | 4/1939 | Hodgman, Jr. |
| 2,180,258 | A | 11/1939 | Rowley |
| 2,732,018 | A | 1/1956 | Grimes |
| 2,768,696 | A | 10/1956 | Sherburne |
| 2,871,953 | A | 2/1959 | Bray |
| 3,007,528 | A | 11/1961 | Gloeckler |
| 3,061,015 | A | 10/1962 | Cann, Jr. |
| 3,080,000 | A | 3/1963 | Gloeckler |
| 3,135,331 | A | 6/1964 | Lee |
| 3,584,689 | A | 6/1971 | Willms |
| 4,007,878 | A | 2/1977 | Anderson |
| 4,091,872 | A | 5/1978 | Mountford |
| 4,177,862 | A | 12/1979 | Bray |
| 4,220,208 | A | 9/1980 | Jackson et al. |

(Continued)

OTHER PUBLICATIONS

Oct. 23, 2007 Extended European Search Report including Oct. 12, 2007 Supplemental European Search Report and European Search Opinion issued in corresponding European Application No. 05849632.4. (8 pages).

(Continued)

*Primary Examiner* — Darren W Gorman
(74) *Attorney, Agent, or Firm* — Perkins Coie LLP

(57) ABSTRACT

A dry sprinkler is provided that includes a structure, a fluid deflecting structure, a locator, a metallic annulus and a shield. The structure defines a passageway extending along a longitudinal axis between an inlet and an outlet. The structure has a rated K-factor defining an expected flow of fluid in gallons per minute from the outlet divided by the square root of the pressure of the flow of fluid fed into the inlet of the passageway in pounds per square inch gauge. The fluid deflecting structure is proximate the outlet. The locator is movable along the longitudinal axis between a first position and a second position. The locator supports the metallic annulus. The metallic annulus includes first and second metallic surfaces spaced apart along the longitudinal axis between an inner and outer circumference with respect to the longitudinal axis. The shield has a first face exposed to the inlet and a second face confronting the first metallic surface to define a gap there between. Various methods are also described.

33 Claims, 3 Drawing Sheets

U.S. PATENT DOCUMENTS

| | | | | |
|---|---|---|---|---|
| 4,228,858 | A | 10/1980 | Sclafani | |
| 4,258,795 | A | 3/1981 | Hansen | |
| 4,417,626 | A | 11/1983 | Hansen | |
| 4,830,117 | A * | 5/1989 | Capasso | 169/90 |
| 5,188,185 | A | 2/1993 | Mears | |
| 5,228,520 | A | 7/1993 | Gottschalk | |
| 5,775,431 | A | 7/1998 | Ondracek | |
| 5,967,240 | A | 10/1999 | Ondracek | |
| 6,152,236 | A | 11/2000 | Retzloff et al. | |
| 6,367,559 | B1 | 4/2002 | Winebrenner | |
| 6,554,077 | B2 | 4/2003 | Polan | |
| 6,851,482 | B2 | 2/2005 | Dolan | |
| 2001/0042795 | A1 | 11/2001 | Franson et al. | |
| 2002/0050531 | A1 | 5/2002 | Dolan | |
| 2003/0075343 | A1 | 4/2003 | Ballard | |
| 2005/0173562 | A1 * | 8/2005 | Franson et al. | 239/498 |
| 2006/0102362 | A1 | 5/2006 | Polan | |

OTHER PUBLICATIONS

Oct. 6, 2008 Examination Report issued in corresponding European Application No. 05849632.4. (2 pages).
International Search Report; International Application No. PCT/US2005/042994; Jun. 8, 2006 (3 pages).
International Preliminary Report on Patentability for PCT/US2005/042994; Jun. 5, 2007, (4 pages).
European Search Report; EP Application No. 05849632; Oct. 10, 2007 (12 pages).
Dry Pendent Drop Sprinkler, Data Sheet AS 1.59 (2 pages).
Engineering Drawings of the Dry Pendent Drop Sprinkler described in Data Sheet AS 1.59. (10 pages).
Viking Corp., Technical Data, "Dry Pendent Sprinklers Model C" Jan. 1987 ( 4 pages).
Chemetron Fire Systems, Model ME-1 Flush Type Dry Pendent:, (4 pages).
Total Walther Feuerschutz GmbH, Hängender Trockensprinkler GHTS 15, Dry Pendent Sprinkler anti-gel Kenblatt-Nr. 4-044-03, Jan. 1989. (2 pages).
Reliable. "Model G3 Dry Sprinkler", Nov. 1987. (4 pages).
Victaulic. Models V3608 and V3607 Standard Spray Pendent and Recessed Pendent Standard and Quick Response, Apr. 2001. (4 pages).
Victaulic. Models V3604 and V3603 Dry Type Upright- Standard and Quick Response, Apr. 2001. (4 pages).
Globe Fire Sprinkler Corporation, "Automatic Sprinklers Model J Bulb Spray Series Dry Type Pendent Recessed Pendent", Aug. 1990. (8 pages).
Globe Fire Sprinkler Corporation, "Dry Pendent Sprinklers Model F960 Designer. 1/2 Orifice", Feb. 2001. (4 pages).
Central Sprinkler Corporation, "Dry Pendent Sprinklers Recessed, Flush and Extended Types Model "A-1", 1986. (2 pages).
Preussag Minimax. "Sprinkler-Teile/Parts Trockensprinkler dry sprinkler", Jan. 1989. (2 pages).
Apr. 28, 2009 Invitation Pursuant to Article 94(3) and Rule 71(1) EPC (EPO Form 2049B) issued by the European Patent Office in counterpart European Patent Application No. 05849632.
The electronic prosecution history of counterpart European Patent Application No. 05849632 retrieved from the European Patent Office, Online Services, Register Plus on Jun. 30, 2009.
Applicant's May 28, 2009 Response to the Apr. 28, 2009 Invitation Pursuant to Article 94(3) and Rule 71(1) EPC (EPO Form 2049B) in counterpart European Patent Application No. 05849632.

* cited by examiner

DRY SPRINKLER WITH DIVERTER SEAL ASSEMBLY

PRIORITY

This application is a Continuation application of U.S. patent application Ser. No. 11/000,129 filed on Dec. 1, 2004, which is incorporated herein by reference in its entirety.

BACKGROUND OF THE INVENTION

Automatic sprinkler systems are some of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. Failures of such systems may occur when the system has been rendered inoperative during building alternation or disuse, or the occupancy hazard has been increased beyond initial system capability.

The fluid supply for a sprinkler system may be separate from that used by a fire department. An underground main for the sprinkler system enters the building to supply a riser. Connected at the riser are valves, meters, and, preferably, an alarm to sound when fluid flow within the system exceeds a predetermined minimum. At the top of a vertical riser, a horizontally disposed array of pipes extends throughout the fire compartment in the building. Other risers may feed distribution networks to systems in adjacent fire compartments. Compartmentalization can divide a large building horizontally, on a single floor, and, vertically, floor to floor. Thus, several sprinkler systems may serve one building.

In the piping distribution network, branch lines carry the sprinklers. A sprinkler may extend up from a branch line, placing the sprinkler relatively close to the ceiling, or a sprinkler can be pendant below the branch line. For use with concealed piping, a flush-mounted pendant sprinkler may extend only slightly below the ceiling.

Fluid for fighting a fire can be provided to the sprinklers in various configurations. In a wet-pipe system, for buildings having heated spaces for piping branch lines, all the system pipes contain water for immediate release through any sprinkler that is activated. In a dry-pipe system, which may include pipes, risers, and feed mains, disposed in unheated open areas, cold rooms, passageways, or other areas exposed to freezing temperatures, such as unheated buildings in freezing climates or cold-storage rooms, branch lines and other distribution pipes may contain a dry gas (air or nitrogen) under pressure. This pressure of gas holds closed a dry pipe valve at the riser. When heat from a fire activates a sprinkler, the gas escapes and the dry-pipe valve trips, water enters branch lines, and fire fighting begins as the sprinkler distributes the fluid.

Dry sprinklers are used where the sprinklers may be exposed to freezing temperatures. A dry sprinkler may include a threaded inlet containing a closure assembly, some length of tubing connected to the threaded inlet, and a fluid deflecting structure located at the other end of the tubing. There may also be a mechanism that connects the thermally responsive component to the closure assembly. The threaded inlet is preferably secured to a branch line. Depending on the particular installation, the branch line may be filled with fluid (wet pipe system) or be filled with a gas (dry pipe system). In either installation, the medium within the branch line is generally excluded from the tubing of the dry sprinkler via the closure assembly until activation of the thermally responsive component. In some dry sprinklers, when the thermally responsive component releases, the closure assembly or portions of the mechanism may be expelled from the tubing of the dry sprinkler by fluid pressure and gravity. In other types of dry sprinklers, the closure assembly is pivotally mounted to a movable mechanism that is a tube structure, and the closure assembly is designed to pivot on a pin pivot axis transverse to the longitudinal axis of the dry sprinkler, while the tube structure is maintained within the tubing of the dry sprinkler.

In known dry sprinklers, a sealing plug has been provided as a component of a closure assembly to seal the inlet of the dry sprinkler. The sealing plug includes a metallic annulus that has a face disposed about a central axis between an inner perimeter and outer perimeter. When the dry sprinkler is in an unactuated condition, the central axis of the sealing plug is generally parallel and aligned with the longitudinal axis of the tubing so that the metallic annulus is elastically deformed. Upon actuation of the dry sprinkler, the metallic annulus provides a force to assist in movement of the closure assembly along the longitudinal axis of the tubing.

In order to utilize the sealing plug, an arrangement of components is provided within the known dry sprinklers. This arrangement of components positions the sealing plug within the passageway defined by the tube structure to prohibit and allow fluid flow through the dry sprinkler. The sealing plug is positioned at the inlet to provide a seal of the inlet, and within the passageway to permit flow through the dry sprinkler. When the sealing plug is positioned to occlude the inlet, the arrangement of components orients the central axis of the sealing plug generally parallel to and aligned with the longitudinal axis. When the sealing plug is positioned within the passage to allow flow through the outlet of the dry sprinkler, the arrangement of components translates the sealing plug along the passageway.

Although the known dry sprinklers have employed a sealing plug with an elastically deformable metallic annulus to translate the closure assembly within the passageway, the arrangement of components, including the sealing plug, has been found to be inadequate for the performance of the dry sprinkler. Specifically, the inventors has discovered that the known arrangements of components apparently fail to provide a flow rate in which the known sprinklers were rated for in a fire protection system.

SUMMARY OF THE INVENTION

The present invention provides a dry sprinkler for a fire protection system. The present invention allows a dry sprinkler to operate over a range of start pressures for a rated K-factor. The present invention provides an operative dry sprinkler by maintaining a positive seal while the dry sprinkler is in a standby, i.e., unactuated mode, and by permitting a flow of at least 95% of the rated flow as determined by the product of the rated K-factor of the sprinkler and the square root of the pressure of the fluid fed to an inlet in pounds per square inch gauge when a heat responsive trigger actuates the dry sprinkler.

In one aspect of the present invention, a dry sprinkler is provided that includes a structure, a fluid deflecting structure, a diverter assembly and a locator assembly. The structure defines a passageway that extends along a longitudinal axis between an inlet and an outlet. The structure has a rated K-factor defining an expected flow of fluid in gallons per minute from the outlet divided by the square root of the pressure of the flow of fluid fed into the inlet of the passageway in pounds per square inch gauge. The fluid deflecting structure is located proximate the outlet. The diverter assembly includes a sealing member, a shield and a mounting portion. The sealing member has first and second metallic surfaces spaced apart along a longitudinal axis between an inner and outer circumference. The first metallic surface has an orthogonal projection with respect to the longitudinal axis to define a first cross-sectional area about the longitudinal axis. The shield has a first surface disposed about the longitudinal axis. The first surface is coupled to a base having a second surface confronting the first metallic surface to define a gap there between. The second surface has a second cross-sectional area disposed generally orthogonal about the longitudinal axis. The second cross-sectional area is less than the first cross-sectional area. The mounting portion has a third face disposed generally orthogonally about the longitudinal axis to define a third cross-sectional area. The third cross-sectional area has a magnitude less than the first cross-sectional area. The locator is disposed in the structure and fixed to the diverter assembly.

In yet another aspect of the present invention, a dry sprinkler is provided that includes a structure, a fluid deflecting structure, a locator, a metallic annulus and a shield. The structure defines a passageway extending along a longitudinal axis between an inlet and an outlet. The structure has a rated K-factor defining an expected flow of fluid in gallons per minute from the outlet divided by the square root of the pressure of the flow of fluid fed into the inlet of the passageway in pounds per square inch gauge. The fluid deflecting structure is proximate the outlet. The locator is movable along the longitudinal axis between a first position and a second position. The locator supports the metallic annulus. The metallic annulus includes first and second metallic surfaces spaced apart along the longitudinal axis between an inner and outer circumference with respect to the longitudinal axis. The metallic annulus occludes a flow of fluid through the passageway when the locator is proximate the first position. The shield has a first face exposed to the inlet and a second face confronting the first metallic surface to define a gap there between.

In a further aspect of the present invention, a dry sprinkler is provided. The dry sprinkler includes a structure, a fluid deflecting structure, a locator and means for establishing a generally symmetric fluid flow path about the longitudinal axis through the outlet at a flow rate of at least 95 percent of the rated K-factor multiplied by the square root of the pressure of the fluid flow fed into the inlet in pounds per square inch gauge. The structure defines a passageway extending along a longitudinal axis between an inlet and an outlet. The structure has a rated K-factor defining an expected flow of fluid in gallons per minute from the outlet divided by the square root of the pressure of the flow of fluid fed into the inlet of the passageway in pounds per square inch gauge. The fluid deflecting structure is proximate the outlet. The locator is movable along the longitudinal axis between a first position and a second position.

In yet another aspect of the invention, a method of operating a dry sprinkler is provided. The dry sprinkler includes a structure extending along a longitudinal axis between an inlet and an outlet. The structure includes a rated K-factor representing a flow of fluid from the outlet of the structure in gallons per minute divided by the square root of the pressure of the fluid fed into the inlet of the structure in pounds per square inch gauge. The method can be achieved by locating a central axis of a diverter assembly generally coincident with respect to the longitudinal axis with the diverter assembly spaced apart from the inlet; and verifying that a rate of fluid flow from the outlet is approximately equal to 95 percent of the rated K-factor of the structure multiplied by the square root of the pressure of fluid in psig fed to the inlet of the structure for each start pressure provided to the inlet prior to an actuation of the dry sprinkler at from approximately 0 to 175 psig.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

As installed, a sprinkler is coupled to a piping network (not shown), which is supplied with a fire fighting fluid, e.g., fluid from a pressurized supply source. The preferred embodiments include dry sprinklers that are suitable for use such as, for example, with a dry pipe system (e.g. that is the entire system is exposed to freezing temperatures in an unheated portion of a building) or a wet pipe system (e.g. the sprinkler extends into an unheated portion of a building). Pipe systems may be installed in accordance with the 2002 Edition of the National Fire Protection Association Standard for the Installation of Sprinkler Systems, NFPA 13 (2002 edition), which is incorporated by reference herein in its entirety.

Figure 1A:
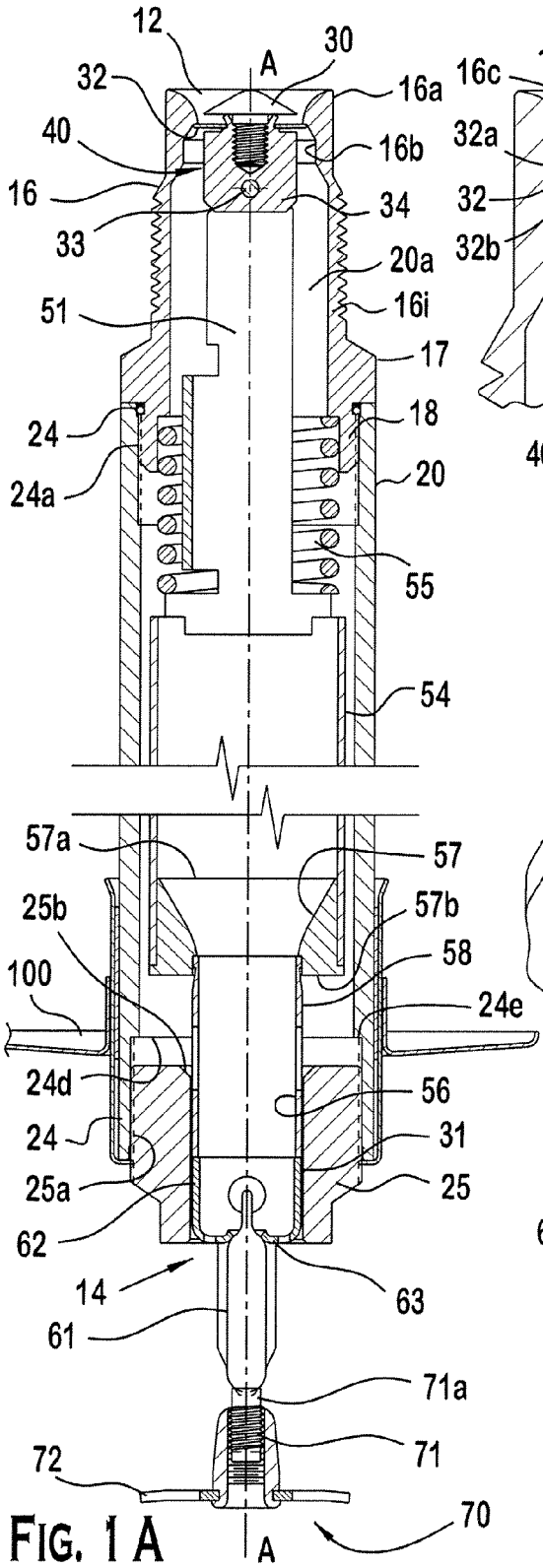
FIGS. 1A-1D illustrate a preferred embodiment of the dry sprinkler.
Figure 1B:
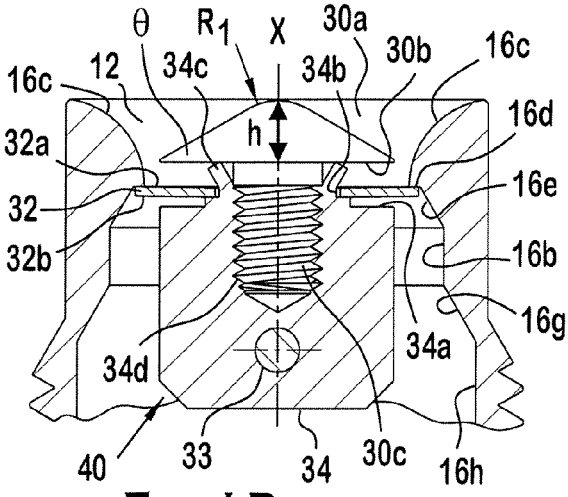
Figure 2:
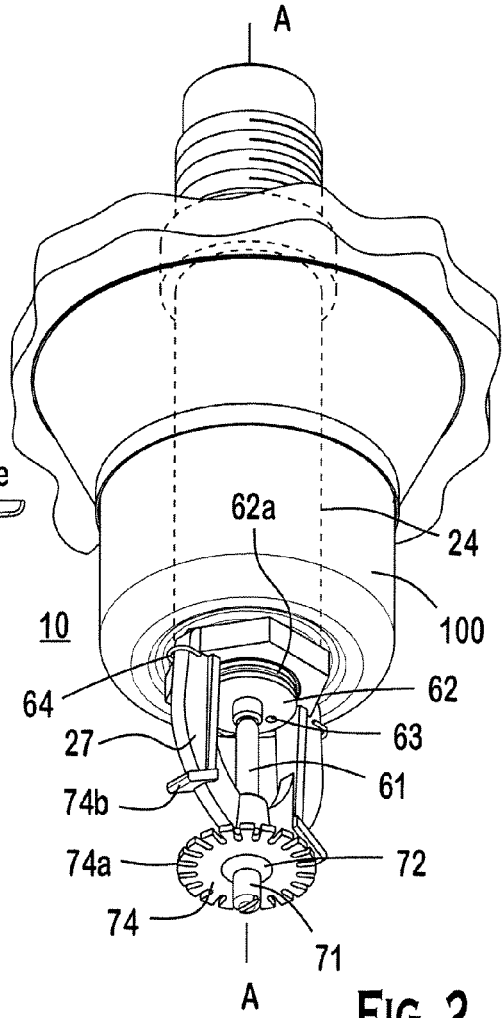
FIG. 2 illustrates the dry sprinkler of FIGS. 1A-1D in an installed configuration.
Figure 1C:
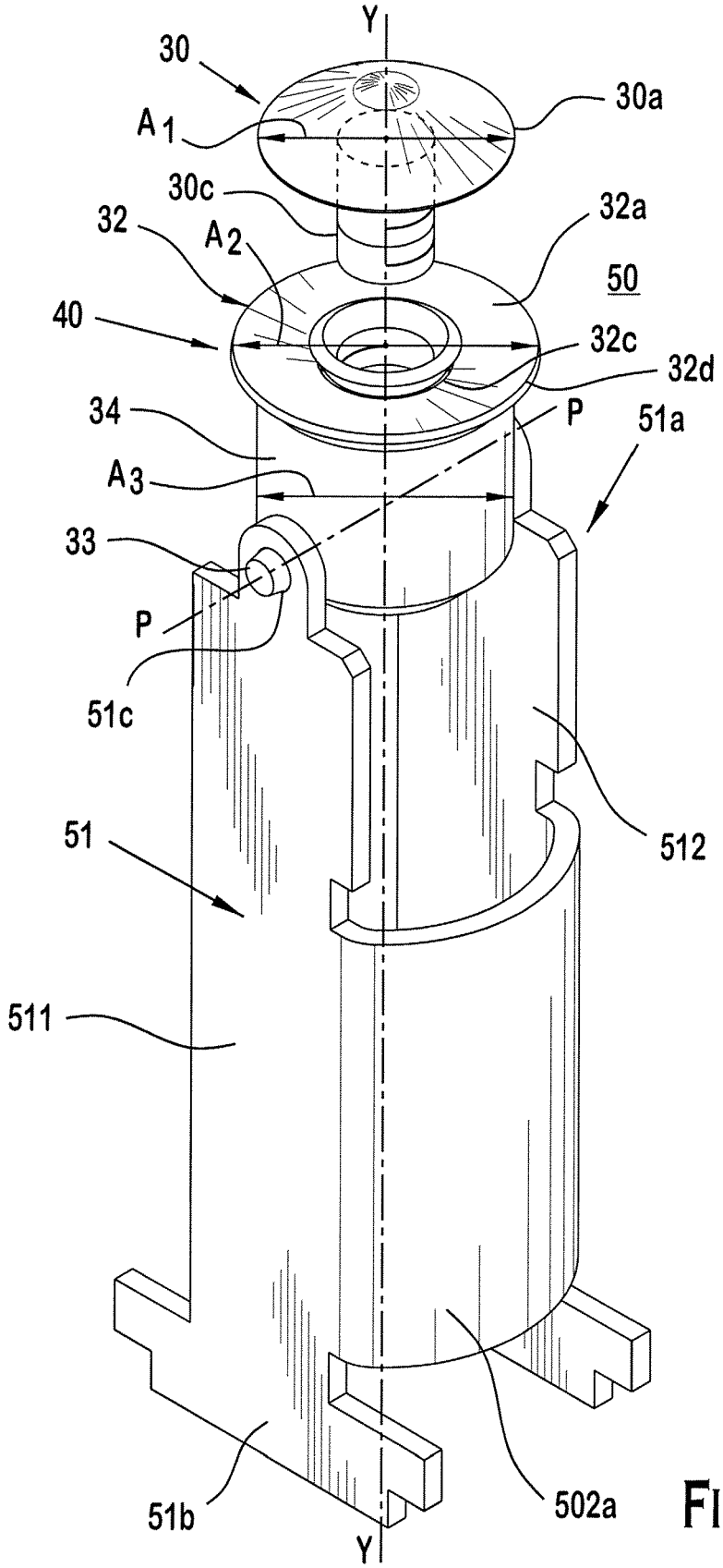
Figure 1D:
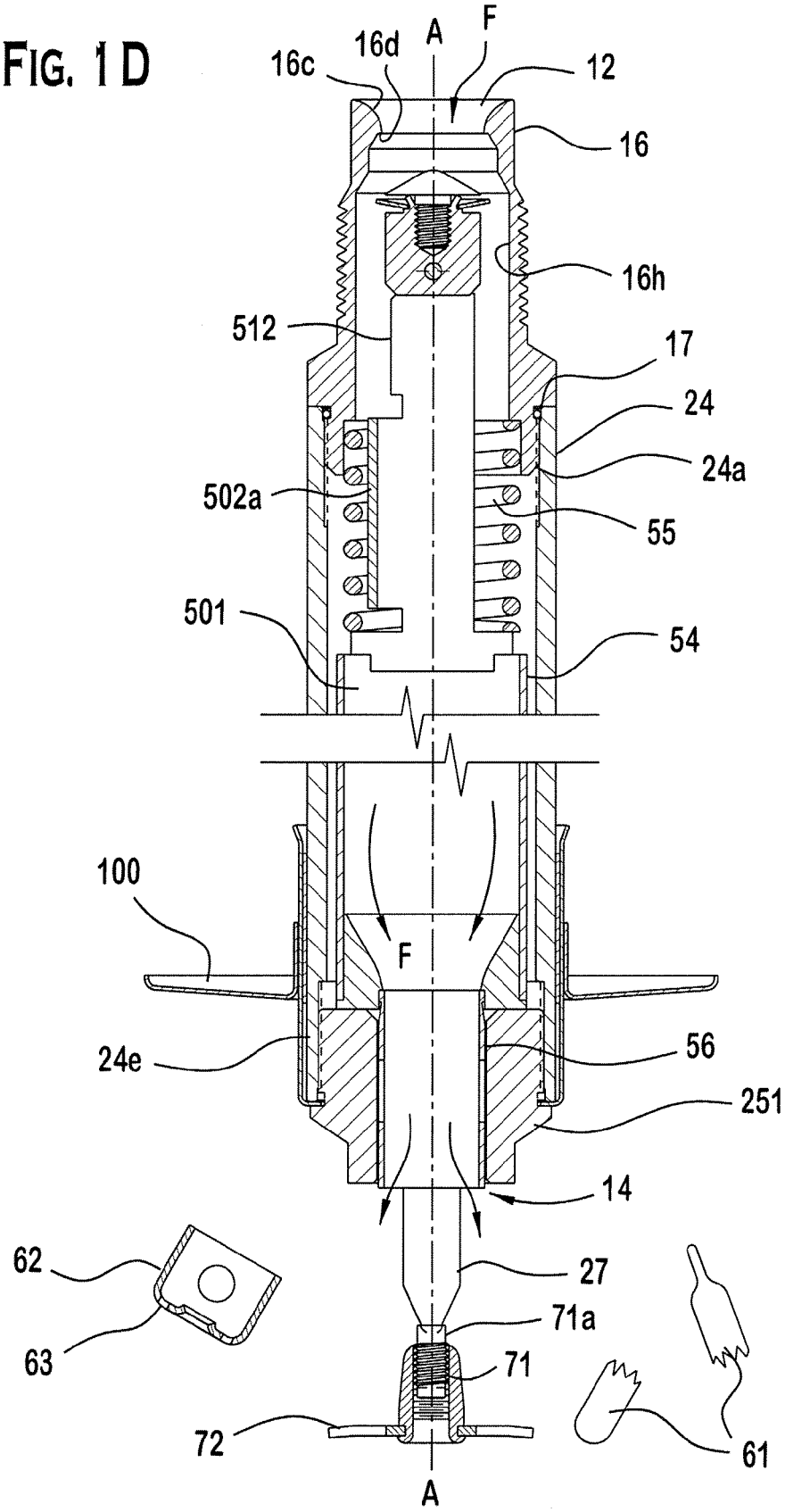

FIGS. 1A, 1B, 1C, 1D, and 2 illustrate preferred embodiments of a dry sprinkler 10. The dry sprinkler 10 includes an outer structure assembly 20, outlet frame 25, locator 50, trigger 61, and fluid deflecting structure 70. The locator 50 includes a diverter assembly 40 and an inner assembly 501 (FIG. 1D). The sprinkler 10 can be mounted through a holder or escutcheon 100 as shown in a perspective view of FIG. 2. The outer structure assembly 20 defines a passageway 20*a* that extends along a longitudinal axis A-A between an inlet 12 and an outlet 14. The longitudinal axis A-A can be a central axis of the geometric center of the outer structure with a generally constant cross-sectional area over an axial length along the longitudinal axis of the structure.

The outer structure assembly 20 includes the inlet fitting 16 coupled to a casing tube 24, and an outlet frame 25 coupled to the casing tube 24. The casing tube 24 has an inner casing tube surface 24*a* that cinctures part of the passageway 20*a*. According to the preferred embodiment, the inner casing tube surface 24*a* has complementary threads formed at one end that cooperatively engage first coupling threads 18 of the inlet fitting 16. The inner casing tube surface 24*a* has third coupling threads 24*d* formed proximate the other end of the casing tube 24. The threads 24*d* terminate at an interior portion 24*e* of the casing tube 24.

The casing tube 24 can be coupled to inlet fitting 16 and outlet frame 25 by any suitable technique, such as, for example, thread connections, crimping, bonding, welding, or by a pin and groove. A stop surface 17 can be provided as part of the inlet fitting 16. According to one configuration of the inlet, the outer inlet fitting surface 16*a* has fitting threads 16*i* formed proximate the inlet 12, and the inner inlet fitting surface 16*b* has first coupling threads formed distal to the threads 16*i*. The fitting threads are used for coupling the dry sprinkler to the piping network, and the inlet fitting 16 has an inlet entrance surface 16*c*. The inlet fitting 16*a* can be provided with at least one of ¾ inch, 1 inch, 1.25 inch NPT and 7-1 ISO (Metric) threads 16*i* formed thereon.

The inlet fitting 16 has an outer inlet fitting surface 16*a* and an inner inlet fitting surface 16*b*. The surface 16*a* cinctures part of the passageway 20*a* to define an entrance surface 16*c* and inlet sealing surface 16*d*. In one preferred embodiment, the entrance surface 16*c* can include a convex profile that forms a compound curved surface intersecting a generally planar surface of the inlet sealing surface 16*d*. The inlet fitting 16 can have various different internal surface configurations proximate the entrance surface 16*c*, however, any suitable configuration may be employed. In the preferred embodiment of FIG. 1A, a radiused entrance surface 16*c* intersects the sealing surface 16*d*, and the entrance surface 16*c* can be a surface disposed about the longitudinal axis that has, in a cross-sectional view, a curved profile converging towards the longitudinal axis A-A.

Alternatively, entrance surface 16*c* can be a frustoconical surface disposed about the longitudinal axis that has, in a cross-sectional view, a linear profile converging towards the longitudinal axis A-A. The sealing surface 16*d* intersects a surface 16*e* diverging, and preferably about 60 degrees, to the longitudinal axis A-A. The surface 16*e* intersects a surface 16*b* extending generally parallel to the longitudinal axis A-A. The generally parallel surface 16*b* intersects a diverging surface 16*g*, which intersects a surface 16*h* generally parallel to the longitudinal axis A-A.

According to the preferred embodiments, the inlet fitting 16 is provided with a radially projecting boss portion 17. The boss portion 17 provides a stop that limits relative threaded engagement between, for example, the inlet fitting 16 and the piping network, the inlet fitting 16 and the casing tube 24, or the outlet frame 25 and the casing tube 24.

According to a preferred embodiment, the inlet fitting 16 is provided with screw threads so that the inlet fitting 16 can be coupled to the casing tube 24 via the threaded portion 18. Alternatively, the inlet fitting 16 and the casing tube 24 can be formed as a unitary member such that thread portion 18 is not utilized. For example, the casing tube 24 can extend as a single tube from the inlet 12 to the outlet 14.

Alternatives to the threaded connection to secure the inlet to the casing can also be utilized such as other mechanical coupling techniques, which can include crimping or bonding. Additionally, either of the respective inner and outer surfaces of the inlet fitting 16, casing tube 24, and outlet frame 25 may be threaded so long as the mating part is cooperatively threaded on the opposite surface, i.e., threads on an inner surface cooperate with threads on an outer surface.

The locator 50 can include a solid member of a predetermined cross-section such that fluid flows through an inner assembly 501. The locator 50, preferably, is disposed within the tubular outer structure assembly 20, which includes the casing tube 24. The terms "tube" or "tubular," as they are used herein, denote an elongate member with a suitable cross-sectional shape transverse to the longitudinal axis A-A, such as, for example, circular, oval, or polygonal. Moreover, the cross-sectional profiles of the inner and outer surfaces of a tube may be different.

The locator 50 is coupled to the inner assembly 501, which includes a fluid tube 54, a guide tube 56, and the trigger 61. In the non-actuated configuration, the locator 50 is coupled to the fluid tube 54, and the fluid tube 54 is coupled to the guide tube 56, and the guide tube 56 is coupled to the trigger seat 62 of the trigger 61. The locator 50 can locate the diverter assembly 40 with respect to the longitudinal axis A-A. The locator 50 has a first yoke support end 51*a* contacting the diverter assembly 40 and a second yoke support end 51*b* coupled to the fluid tube 54. The locator 50 may optionally include a biasing member that in a preferred embodiment includes an assist spring 55 to assist movement of the locator 50 from its unactuated position (FIG. 1A) to an actuated position (FIG. 1D).

Referring to FIG. 1C, the locator 50 has a central axis Y extending generally coincident with the longitudinal axis A-A. Locator 50 has two main portions 511 and 512 symmetric about the central axis Y. Each of the main portions has a first end and a second end 51*a* and 51*b*. A connecting portion 502*a* connects the main portions 511 and 512 between a first end 51*a* and a second end 51*b* of each of the main portions 511 and 512. The main portions 511 and 512 are each provided with an opening 51*c* extending along an axis P-P transversely intersecting the yoke axis Y. The diverter assembly 40 is fixed to the connector 33 so that the diverter assembly 40 is not free to translate with respect to the locator 50.

As shown in FIG. 1C, the connecting portion 502*a* can be a single arcuate member connecting the main portions 511 and 512 on one side of the axis Y to form an elongate member having an arcuate channel extending between the ends of the main portions 511 and 512. Locator 50 has some freedom of movement relative to the fluid tube 54 as long as the fluid flow F through the inlet forms a generally symmetric flow path about the locator 50.

In lieu of the connector 33 of the preferred embodiment, the diverter assembly 40 can be fixed to the locator 50 by a rivet, bolt and nut, screw, two pins, a protrusion cooperating with a recess, or any suitable arrangement that prevents the diverter assembly 40 from rotating with respect to the locator 50 and also allows for compression of the metallic annulus 32 against the sealing surface 16*d* in a closed position of the dry sprinkler 10.

Due to the alignment of the diverter assembly 40 with the sealing surface 16*d* of the inlet fitting 16 in the closed position (FIG. 1A), locator 50 is generally coaxial with the longitudinal axis A-A in the closed position. Due to the assist spring 55 acting against the asymmetric connecting portion 502*a*, locator 50 translates along the longitudinal axis A-A in the open position of the dry sprinkler (FIG. 1D) such that the outer circumference 32*d* of the metallic annulus 32 separates from the sealing surface 16*d* and circumscribes the longitudinal axis A-A to permit a flow of fluid around the shield 30 in a generally symmetric flow path through the passageway 20*a*.

Various configurations of the outlet frame can be used with the dry sprinklers of the preferred embodiments. Any suitable outlet frame, however, may be used so long as the outlet frame positions a fluid deflecting structure proximate the outlet of the dry sprinkler. A preferred outlet frame 25 is shown in FIG. 1A. Another preferred outlet frame 251 is shown in FIG. 1D.

The outlet frame 25 has an outer outlet frame surface 25*a* and an inner outlet frame surface 25*b*, which surfaces cincture part of the passageway 20*a*. The outer outlet frame surface 25*a* can be provided with coupling threads formed proximate one end of the outlet frame 25 that cooperatively engage coupling threads of the structure 20. The outlet frame 25 has an opening 31 so that an annular member, such as a trigger seat 62, can be mounted therein.

The other end of the outlet frame 25 can include at least one frame arm 27 that is coupled to the fluid deflecting structure 70. Preferably, the outlet frame 25 and frame arm 27 are formed as a unitary member. The outlet frame 25, frame arm 27, and fluid deflecting structure 70 can be made from rough or fine casting, and, if desired, machined.

The thermal trigger 61 is disposed proximate to the outlet 14 of the sprinkler 10. Preferably, the trigger 61 is a frangible bulb that is interposed between a trigger seat 62 and the fluid deflecting structure 70. Alternatively, the trigger 61 itself can be a solder link, or any other suitable heat responsive arrangement instead of a frangible bulb. Instead of a frangible bulb or a solder link, the heat responsive trigger may be any suitable arrangement of components that reacts to the appropriate condition(s) by actuating the dry sprinkler.

The trigger 61 operates to: (1) maintain the inner tubular assembly proximate the first position over the first range of temperatures between about minus 60 degrees Fahrenheit to about just below a temperature rating of the trigger; and (2) permit the inner tubular assembly to move along the longitudinal axis to the second position over a second range of temperatures at or greater than the temperature rating of the trigger. The temperature rating can be a suitable temperature such as, for example, about 134, 155, 175, 200, or 286 degrees Fahrenheit and plus or minus (+) 20% of each of the stated values.

The trigger seat 62 can be an annular member with a nub portion formed at one end of the trigger seat 62. The trigger seat 62 may also include a drain port 63. The nub portion has an interior cavity configured to receive a terminal end of the frangible bulb 61. The trigger seat 62 has a biasing spring 64 located in a groove 62*a*. The spring 64 is connected to the frame arms 27 of the fluid deflecting structure 70. A spacer (not shown) can be located between the second guide tube portion 58 and the trigger seat 62. The longitudinal thickness of the spacer would be selected to increase the travel of the locator 50 as it moves from the first position to the second position. In particular, the longitudinal thickness of the spacer would be selected to establish a predetermined travel of the locator 50 before the second end 57*b* located distally of the first end 57*a* of the first guide tube portion 57 comes to rest on the outlet frame 25.

The fluid deflecting structure 70 may include an adjustment screw 71 and a planar surface 74 coupled to the frame arm 27 of the outlet frame 25. The adjustment screw 71 is provided with external threads 73 that can be used to adjust an axial spacing between the trigger seat 62 and the frangible glass bulb 61. The adjustment screw 71 also has a screw seat portion 71*a* that engages the frangible bulb 61. Although the adjustment screw 71 and the planar surface member 74*a* have been described as separate parts, they can be formed as a unitary member.

A generally planar surface member 74 can be coupled to the adjustment screw 71. The planar surface member 74 can be provided with a plurality of tines 74*a* and a plurality of slots, which are disposed in a predetermined periodic pattern about the longitudinal axis A-A so as to deflect the fluid flow F to form an appropriate spray pattern. Instead of a planar surface 74, other configurations could be employed to provide the desired fluid deflection pattern. Preferably, the member 74 includes a plurality of tines 74*a* disposed equiangularly about the longitudinal axis A-A that cooperates with deflecting arms 74*b* formed on the frame arm 27 to deflect fluid over a desired coverage area.

The dry sprinkler 10 can extend for a predetermined length L from, for example, a ceiling, a wall, or a floor of an enclosed area. The length L can be any value, and preferably, between two to fifty inches depending on the application of the sprinkler 10.

To form a seal with the sealing surface 16*d* of the inlet fitting 16, a diverter assembly 40 can be used. The diverter assembly 40 includes a shield 30, a metallic annulus 32 and a mounting portion 34. The shield 30 includes a first face 30*a* and a second face 30*b* disposed about a central axis X-X. The central axis X-X preferably defines an axis of the diverter assembly 40, and more particularly, an axis of the first face 30*a*. The first face 30*a* of the shield 30 extends continuously between the central axis X-X and an outer perimeter of the shield. The first face 30*a* forms an air gap with the inlet surface 16*c* and preferably forms an air gap with both the inlet surface 16*c* and the metallic annulus 32. Preferably, the first face 30*a* has circumference of about 0.5 inches with respect to the central axis X-X, the first face 30 defining a generally conic surface that extends at an included angle of about 30 degrees with respect to the second face 30*b* with a tip portion of the conic surface having a radius of curvature R1 of about 0.125 inches with respect to the central axis X-X, where the tip portion is located at a distance "h" of about ⅛ inches from the second face 30*b*. The diverter assembly 40 also includes a resilient metallic annulus 32. The metallic annulus 32 includes a first metallic surface 32*a* and a second metallic surface 32*b* spaced apart between an inner circumference 32*c* to an outer circumference 32*d* with respect to the central axis X-X. Preferably, the metallic annulus 32 is member that, in its uncompressed state, may have a frustoconical configuration with a base of the frustum facing the inlet, and in a compressed state, has a generally planar configuration with respect to its central axis X-X. The metallic annulus 32 can be formed by a suitable resilient material that provides for an appropriate axial spring force as the diverter changes from a compressed to an uncompressed state. The resilient material for the diverter can be, for example, stainless steel, beryllium, nickel or combinations thereof. A coating may be provided on the diverter such as, for example, synthetic rubber, Teflon™, or nylon. The metallic annulus 32 can be disposed on the mounting portion 34 so that a third face 34*a* of the mounting portion 34 confronts the second metallic surface 32*b* of the metallic annulus 32. The third face 34*a* includes a boss portion 34*b* that supports the inner circumference 32*c* of the metallic annulus 32. The third face 34*a* also includes an extension portion 34*c* that extends between the inner circumference 32*c* of the metallic annulus 32 and the second face 30*b* of the shield 30. Preferably, the resilient material is a beryllium and nickel alloy categorized as UNS N03360, 1/2 hard.

The first face 30*a* and second face 30*b* of the shield 30 is preferably provided by a unitary member having a threaded shank portion 30*c* of about 0.2 inches in length along the central axis X-X that can be used to connect the first and second faces 30*a*, 30*b* to the mounting aperture 34*d* of the mounting portion 34. The second face 30*b* has a first cross-sectional area A1 orthogonal to the central axis X-X less than a second cross-sectional area A2 of the metallic annulus 32 as projected orthogonally with respect to the central axis X-X. The third face 34*a* of the mounting portion 34 has a third cross-sectional area A3 orthogonally with respect to the central axis X-X preferably the same as the first cross-sectional area A1.

The mounting portion 34 can be coupled to the locator 51 via a connector 33 fixed to both the mounting portion 34 and an opening 51*c* of the locator 51. Preferably, the mounting portion 34 is fixed to the locator 51 with a suitable connector, such as, for example, a rivet or threaded screw so that the mounting portion 34 is not rotatable about the connector 33.

The metallic annulus 32 of the diverter assembly 40, in conjunction with the sealing surface 16*d* of the inlet fitting 16, can form a seal against fluid pressure proximate the sealing surface 16*d* at any start pressure from approximately zero to approximately 175 psig so that the third face 34*a* of the mounting portion 34 facing the outlet 14 is generally free of fluid. In particular, a start pressure, i.e., an initial pressure present at the inlet when the dry sprinkler is actuated, can be at various start pressures. Preferably, the start pressure is at least 20 pounds per square inch (psig), and, more particular, greater than 100 psig.

Preferably, the dry sprinkler 10 has a rated discharge coefficient, or rated K-factor, that is at least 5.6, and, can be 8.0, 11.2, 14.0, 16.8, 22.4 or 25.5. However, any suitable value for the K-factor could be provided for the dry sprinkler of the preferred embodiments. As used herein, the discharge coefficient or K-factor is quantified as a flow of fluid, preferably, fluid, from the outlet 14 of the outer structure assembly 20, e.g. in gallons per minute (GPM), divided by the square root of the pressure of the fluid fed into the outer structure assembly 20, e.g., in pounds per square inch gauge (psig). The rated K-factor, or rated discharge coefficient is a mean value. The rated K-factors are expressed in standard sizes, which have an acceptable range, which is approximately five percent or less deviation from the standard value over the range of pressures. For example, a "rated" K-factor of 11.2 encompasses all measured K-factors between 11.0 and 11.5. The K-factors of the preferred embodiment may decrease as the sprinkler length L increases. For example, when L is 48 inches, the K-factor of the dry sprinkler 10 can be reduced from 11.2 to approximately 10.2.

The K-factor allows for an approximation of flow rate to be expected from the outlet of a sprinkler based on the square root of the pressure of fluid fed into the inlet of the sprinkler. In relation to the preferred embodiments, the dry sprinkler of each of the preferred embodiments has a rated K-factor of at least 5.6. Based on the rated K-factor of the dry sprinkler of the preferred embodiments, each dry sprinkler has an arrangement of components that allows for an actual minimum flow rate in gallons per minute (GPM) through the outlet as a product of the rated K-factor and the square root of the pressure in pounds per square inch gauge (psig) of the fluid fed into an inlet of the dry sprinkler of each preferred embodiment. Specifically, the preferred embodiment has an actual minimum flow rate from the outlet 14 of approximately equal to 95% of the magnitude of a rated K-factor times the square root of the pressure of the flow of fluid fed into the inlet of each embodiment.

To minimize the restriction upon the fluid flowing through outer structure assembly 20 of the dry sprinkler 10, the diverter assembly 40 can include a suitable shape that presents as small a frontal area and as small a coefficient of drag as suitable when the diverter assembly 40 is translated to the open position. In particular, a frontal surface area is provided by the first face 30*a* of the shield 30 and the metallic annulus 32. Preferably, by virtue of the shape of the first face 30*a*, a flow of fluid through the inlet is diverted into a generally symmetrical flow path about the shield 30 when the locator is translated to a second position (FIG. 1D) in the structure 24. And more preferably, the flow of fluid is diverted by the shield 30 when the locator is translated to a second position so that a majority of the flow does not impinge upon the metallic surface 32*a* of the annulus 32 during operation of the dry sprinkler where the pressure of the fluid flow F is between 0 and 175 psig and the flow rate is about 95% of the rated K-factor times the square root of the pressure of the fluid fed to the inlet. In particular, the cross-sectional area A1 of the shield is less than the largest cross-sectional area A2 of the diverter assembly 40 and the height "h" of the shield and the angle of inclination 0 with respect to an orthogonal axis relative to axis X-X are configured so that the majority of flow does not impinge upon operational flow of fluid through the dry sprinkler. In the preferred embodiments, the first face 30*a* is configured with the height "h" so that the face 30*a* does not extend past the outer periphery of inlet surface 16*c*.

The diverter assembly 40 is supported by contacting the mounting portion 34 against a portion of the locator 50 so that the metallic annulus 32 of the diverter assembly 40, in an unactuated position of the dry sprinkler 10, engages a sealing surface 16*d* of the inlet fitting 16. During engagement with the sealing surface 16*d*, the first metallic surface 32*a* of the metallic annulus 32 of the diverter assembly 40 is preferably compressed against the sealing surface 16*d* such that the central axis X-X of the metallic surface 32*a* is generally coaxial with the longitudinal axis A-A and the shield 30 acts to reduce the formation of an ice dam on the inlet surface 16*c*. When the dry sprinkler 10 is actuated by activation of the trigger 61 so that the metallic annulus 32 is biased from the sealing surface 16*d*, the metallic annulus 32 forms a generally truncated cone with its central axis X-X generally coaxial with the longitudinal axis A-A. Preferably, each of the inlet fitting, means for establishing a generally symmetric flow, the first face 30*a* or bias member 55 can be made of a copper, bronze, galvanized carbon steel, carbon steel, or stainless steel material.

In operation, when the trigger 61 is actuated, e.g., by shattering where the trigger is frangible bulb, the trigger 61 separates from the dry sprinkler 10. The separation of the trigger 61 removes the support for the locator 50 against the resilient spring force of the metallic annulus 32 or the mass of the fluid at the inlet 12. Consequently, the metallic annulus 32 separates from the sealing surface 16*d* as the diverter assembly 40 translates along with the locator 50 and inner assembly 501. The axial force provided by the metallic annulus 32 or the spring 55 assists in separating the diverter assembly 40 from the inlet fitting 16. Thereafter, fluid or a suitable firefighting fluid is allowed to flow through the inlet 12. Due to the configuration of the diverter assembly 40, including the first face 30*a*, fluid flow F through the inlet 12 to the outlet 14 forms a generally symmetric flow path about the axis A-A through a portion of the passageway 20*a*. Hence, the diverter assembly 40 and the locator 50 provide the means for establishing a generally symmetric fluid flow F path about the longitudinal axis A-A through the outlet at a flow rate of at least 95 percent of the rated K-factor multiplied by the square root of the pressure of the fluid flow F fed to the inlet 12 in pounds per square inch gauge. Thereafter, the deflector 72 distributes the fluid flow F over a protection area below the sprinkler 10. It should be noted that the means, however, do not include any sealing member whose sealing member is positioned, in its entirety, offset or asymmetric to the longitudinal axis A-A in the passageway 20*a* in either in the closed or opened position of the locator 50.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A dry sprinkler having an unactuated state and an actuated state, the sprinkler comprising:

an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a diverter assembly disposed in the passageway, the diverter assembly including:

a sealing member having first and second metallic surfaces axially spaced apart between an inner and outer circumference;

a shield centered about the longitudinal axis, the shield having a first surface and a second surface confronting the first metallic surface; and a mounting portion engaged with the sealing member and the shield; and a locator disposed in the passageway to locate the diverter assembly along the longitudinal axis such that in the unactuated state the sealing member is engaged with the sealing surface and in the actuated state the sealing member is located along a portion of the passageway spaced from the sealing surface, the locator further being fixed to the diverter assembly such that the shield remains centered about the longitudinal axis and does not translate with respect to the locator in the unactuated state and actuated state, the locator including two portions with a connector in between to space the two portions symmetrically apart about a locator axis that is generally coaxially aligned with the longitudinal axis, the connector defining a channel of the locator.

2. The dry sprinkler of claim 1, wherein the K-factor is greater than 14.

3. The dry sprinkler of claim 2, wherein the K-factor is 16.8.

4. The dry sprinkler of claim 1, further comprising a trigger to support the locator in the unactuated state, the trigger having a temperature rating of any one of 134, 155, 175, 200 or 286 degrees Fahrenheit.

5. The dry sprinkler of claim 1, wherein the inlet fitting includes threads for connecting to a piping network, the threads being any one of NPT and 7-1 ISO (Metric) threads.

6. A dry sprinkler having an unactuated state and an actuated state, the sprinkler comprising: p1 an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a diverter assembly disposed in the passageway, the diverter assembly including:

a sealing member having first and second metallic surfaces axially spaced apart between an inner and outer circumference;

a shield having an outer perimeter disposed about the longitudinal axis, the shield having a first surface and a second surface confronting the first metallic surface; and a mounting portion engaged with the sealing member and the shield; and a locator disposed in the passageway to locate the diverter assembly along the longitudinal axis such that in the unactuated state the sealing member is engaged with the sealing surface and in the actuated state the sealing member is located along a portion of the passageway spaced from the sealing surface, the locator further being fixed to the diverter assembly such that the shield perimeter remains disposed about the longitudinal axis, the locator including two portions substantially symmetrically spaced apart about the longitudinal axis so as to define at least one opening disposed to one side of the longitudinal axis.

7. The dry sprinkler of claim 6, wherein the sealing surface is planar, disposed about and perpendicular to the longitudinal axis; the inlet including an entrance surface disposed about the longitudinal axis, the entrance surface converging toward the longitudinal axis so as to define a curved profile intersecting the sealing surface, the inlet further including a diverging surface disposed about the longitudinal axis, the diverging surface intersecting the sealing surface and defining a profile diverging from the longitudinal axis at an angle.

8. The dry sprinkler of claim 6, wherein the locator includes a connector portion disposed to one side of the longitudinal axis connecting the two spaced apart portions so as to define a locator axis that is generally coincident with the longitudinal axis.

9. The dry sprinkler of claim 6, wherein in the actuated state, the shield does not translate relative to the locator.

10. A dry sprinkler having an unactuated state and an actuated state, the sprinkler comprising:

an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a sealing member having a first metallic surface and second metallic surface axially spaced apart between an inner circumference and outer circumference of the sealing member, the inner and outer circumferences being centered about a sealing member axis;

an assist spring disposed in the passageway; and a locator having a tubular inner assembly, the locator disposed in the passageway to locate the sealing member along the longitudinal axis such that in the unactuated state the sealing member is engaged with the sealing surface with the inner circumference of the sealing member being circumscribed about the longitudinal axis, and in the actuated state the sealing member is located along a portion of the passageway spaced from the sealing surface, the locator further being coupled to the sealing member such that in the actuated state, the inner circumference of the sealing member remains circumscribed about the longitudinal axis such that the fluid flow through the outlet is at a flow rate of at least 95 percent of the rated K-factor multiplied by the square root of the pressure of the fluid flow fed into the inlet in pounds per square inch gauge.

11. The dry sprinkler of claim 10, further comprising a diverter assembly disposed in the passageway, the diverter assembly including a mounting portion and a frontal surface having an outer perimeter circumscribed about the longitudinal axis.

12. The dry sprinkler of claim 11, wherein the frontal surface of the diverter assembly comprises a diverter member, wherein further the diverter member does not translate with respect to the locator in the unactuated state and actuated state.

13. The dry sprinkler of claim 12, wherein the diverter member comprises a shield.

14. The dry sprinkler of claim 10, wherein the sealing member axis remains coincident to the longitudinal axis in the actuated state.

15. A dry sprinkler having an unactuated state and an actuated state, the sprinkler comprising:

an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a sealing member having a first metallic surface and second metallic surface axially spaced apart between an inner circumference and outer circumference of the sealing member, the inner and outer circumferences being centered about a sealing member axis; and a locator disposed in the passageway to locate the sealing member along the longitudinal axis such that in the unactuated state the sealing member is engaged with the sealing surface with the inner circumference of the sealing member being circumscribed about the longitudinal axis, and in the actuated state the sealing member is located along a portion of the passageway spaced from the sealing surface, the locator further being coupled to the sealing member such that in the actuated state, the inner circumference of the sealing member remains circumscribed about the longitudinal axis such that the fluid flow through the outlet is at a flow rate of at least 95 percent of the rated K-factor multiplied by the square root of the pressure of the fluid flow fed into the inlet in pounds per square inch gauge, wherein the locator includes two portions substantially symmetrically spaced apart about a locator axis that is generally coincident with the longitudinal axis, the spaced apart portions defining at least one opening disposed to one side of the locator axis.

16. The dry sprinkler of claim 10, wherein the sealing surface is planar, disposed about and perpendicular to the longitudinal axis; the inlet including an entrance surface disposed about the longitudinal axis, the entrance surface converging toward the longitudinal axis so as to define a curved profile intersecting the sealing surface, the inlet further including a diverging surface disposed about the longitudinal axis, the diverging surface intersecting the sealing surface and defining a profile diverging from the longitudinal axis at an angle.

17. A dry sprinkler having an unactuated state and an actuated state, the sprinkler comprising:

an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a sealing member having a first metallic surface facing the inlet of the sprinkler and a second metallic surface axially spaced apart between an inner circumference and outer circumference of the sealing member, the inner and outer circumferences being centered about a sealing member axis; and a locator disposed in the passageway to locate the sealing member along the longitudinal axis such that in the unactuated state the first metallic surface of the sealing member is engaged with the sealing surface with the inner circumference of the sealing member being circumscribed about the longitudinal axis, and in the actuated state the sealing member is located along a portion of the passageway spaced from the sealing surface in one of the inlet fitting and casing tube, the locator further being coupled to the sealing member such that in the actuated state, the inner circumference of the sealing member remains circumscribed about the longitudinal axis such that the fluid flow through the outlet is at a flow rate of at least 95 percent of the rated K-factor multiplied by the square root of the pressure of the fluid flow fed into the inlet in pounds per square inch gauge, the locator including a tubular inner assembly disposed in the passageway.

18. The dry sprinkler of claim 10, the locator including two portions with a connector in between to space the two portions symmetrically apart about a locator axis that is generally coaxially aligned with the longitudinal axis, the connector defining a channel of the locator.

19. The dry sprinkler of claim 10, the locator including two portions substantially symmetrically spaced apart about the longitudinal axis so as to define at least one opening disposed to one side of the longitudinal axis.

20. A dry sprinkler having an unactuated state and an actuated state, the sprinkler comprising:

an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a sealing member having first and second metallic surfaces, one of the first and second metallic surfaces providing a sealing member surface facing the sealing surface and defining an outer peripheral edge of the sealing member disposed about the longitudinal axis; and a locator including a tubular inner assembly, the locator disposed in the passageway between the inlet and the tubular inner to locate the sealing member outer peripheral edge about to circumscribe the longitudinal axis in both the unactuated and actuated states, with the sealing member engaged with the sealing surface in the unactuated state, and with the sealing member located along a portion of the passageway spaced from the sealing surface in the actuated state, the locator further being coupled to the sealing member such that fluid flow through the outlet in the actuated state is at a flow rate of at least 95 percent of the rated K-factor multiplied by the square root of the pressure of the fluid flow fed into the inlet in pounds per square inch gauge.

21. The dry sprinkler of claim 20, the sealing member having a compressed configuration in the unactuated state and an uncompressed configuration in the actuated state.

22. The dry sprinkler of claim 21, the outer peripheral edge of the sealing member extending towards the sealing surface when the sealing member is in the uncompressed configuration.

23. The dry sprinkler of claim 20, the outer peripheral edge being located along the longitudinal axis between the sealing surface and an inner peripheral edge of the sealing member in the actuated state.

24. The dry sprinkler of claim 20, the locator coupled to the sealing member with a projection disposed on the longitudinal axis, at least a portion of the projection being disposed on a side of the sealing member having the sealing member surface.

25. The dry sprinkler of claim 24, the projection having a conical surface defining a tip portion disposed on the longitudinal axis in the actuated state.

26. The dry sprinkler of claim 25, the projection being a shield.

27. A dry sprinkler having an unactuated state and an actuated state, the sprinkler comprising:

an inlet fitting having an inner surface defining an inlet of the dry sprinkler, the inlet including a sealing surface;

an outlet frame having an inner surface defining an outlet of the dry sprinkler;

a casing tube having an inner surface, the casing tube coupling the inlet fitting to the outlet frame such that the inner surface of the inlet fitting, the inner surface of the outlet frame and the inner surface of the casing tube define a passageway extending along a longitudinal axis between the inlet and the outlet, the inner surface of the inlet fitting defining a first diameter of the passageway about the longitudinal axis and the inner surface of the casing tube defining a second diameter different from the first, the passageway defining a rated K-factor being an expected flow of fluid in gallons per minute from the outlet divided by the square root of the pressure of the flow of fluid fed into the inlet of the passageway in pounds per square inch gauge;

a fluid deflecting structure located at a fixed axial distance from the outlet such that the axial distance is the same in both the unactuated state and the actuated state;

a diverter assembly disposed in the passageway, the diverter assembly including:

a sealing member defining a central axis that is generally coaxial with the longitudinal axis and having first and second metallic surfaces axially spaced apart between an inner and outer circumference; and a projection member having a first and second surfaces, the second surface confronting the first metallic surface; and a locator disposed in the passageway to locate the diverter assembly along the longitudinal axis such that in the unactuated state the sealing member is engaged with the sealing surface and in the actuated state the sealing member is located along a portion of the passageway spaced from the sealing surface, the locator further being fixed to the diverter assembly such that the sealing member central axis remains generally coaxial with the longitudinal axis in both the unactuated and actuated states.

28. The dry sprinkler of claim 27, wherein the K-factor is greater than 14.

29. The dry sprinkler of claim 28, wherein the K-factor is 16.8.

30. The dry sprinkler of claim 27, further comprising a trigger to support the locator in the unactuated state, the trigger having a temperature rating of any one of 134, 155, 175, 200 or 286 degrees Fahrenheit.

31. The dry sprinkler of claim 27, wherein the inlet fitting includes 3/4-inch threads for connecting to a piping network, the threads being any one of NPT and 7-1ISO (Metric) threads.

32. The dry sprinkler of claim 27, wherein the projection member comprises a shield.

33. The dry sprinkler of claims 1, 6, 10, 15, 17 and 27, wherein, in the actuated state, the sealing member is located in the inlet fitting.

* * * * *

UNITED STATES PATENT AND TRADEMARK OFFICE

CERTIFICATE OF CORRECTION

PATENT NO. : 8,225,881 B2
APPLICATION NO. : 12/436290
DATED : July 24, 2012
INVENTOR(S) : Manuel R. Silva, Jr.

It is certified that error appears in the above-identified patent and that said Letters Patent is hereby corrected as shown below:

In the Claims:

Column 15, lines 2 and 3, after "surface", please delete "in one of the inlet fitting and casing tube";

Column 15, lines 52 and 53, after "passageway", please delete "between the inlet and the tubular inner";

Column 15, lines 54, after "edge", please delete "about".

Signed and Sealed this
Thirteenth Day of August, 2013

Teresa Stanek Rea
*Acting Director of the United States Patent and Trademark Office*